United States Patent [19]

Vuilleumier

[11] Patent Number: 4,676,659

[45] Date of Patent: Jun. 30, 1987

[54] INTERMITTENT DRIVING ARRANGEMENT FOR A TIME INDICATOR

[75] Inventor: Cyril Vuilleumier, Bienne, Switzerland

[73] Assignee: ETA SA Fabriques d'Ebauches, Grenchen, Switzerland

[21] Appl. No.: 911,948

[22] Filed: Sep. 26, 1986

[30] Foreign Application Priority Data

Sep. 27, 1985 [CH] Switzerland ..... 04198/85

[51] Int. Cl.[4] ..... G04B 19/20

[52] U.S. Cl. ..... 368/37

[58] Field of Search ..... 368/28, 34–37

[56] References Cited

U.S. PATENT DOCUMENTS

| | | | |
|---|---|---|---|
| 3,695,035 | 10/1972 | Cleusly | 368/22 |
| 3,854,280 | 12/1974 | Wuthrich | 368/221 |
| 4,081,950 | 4/1978 | Chappatte | 368/37 |
| 4,478,522 | 10/1984 | Ammann | 368/37 |

FOREIGN PATENT DOCUMENTS

| | | | |
|---|---|---|---|
| 0079301 | 5/1983 | European Pat. Off. . | |
| 1460172 | 11/1966 | France | 368/37 |
| 2274081 | 2/1976 | France . | |
| 526187 | 9/1940 | United Kingdom . | |
| 2089534 | 6/1982 | United Kingdom . | |

*Primary Examiner*—Vit W. Miska

*Attorney, Agent, or Firm*—Griffin, Branigan, & Butler

[57] ABSTRACT

A time indicator for a timepiece is driven by an arrangement comprising a driving train and a transmission assembly. The driving train includes a finger adapted to drive a pinion of small diameter and a circular flange adapted to block a pinion of large diameter. The small and large diameter pinions are coaxial, fixed to one another and compose the transmission assembly. In this manner the time interval in passing from one indication to another is diminished while avoiding the butting phenomenon of teeth resting on the circular flange.

5 Claims, 5 Drawing Figures

INTERMITTENT DRIVING ARRANGEMENT FOR A TIME INDICATOR

The purpose of this invention is to provide an intermittent driving arrangement for a time indicator in a timepiece including a driving train driven in continuous rotation by the movement of said timepiece, and a transmission assembly driven in discontinuous rotation by said driving assembly, said assembly driving in its turn said time indicator.

BACKGROUND OF THE INVENTION

It is well known that in analog display type watches display of the data is obtained in a classic manner by a disc or crown which bears on one of its surfaces the numbers from 1 to 31, said numbers running successively past an opening arranged in the dial of the timepiece. This indicator is driven in rotation by the gear train in a manner such that it progresses through one step every twenty-four hours. The blocking at each of the display positions of the date indicator is usually obtained by an elastic latching member successively engaging between the teeth arranged on the disc or crown as the indicator advances. During the daily actuation of such indicator, the driving force which must be applied thereto is thus clearly greater than the normal driving force necessary to drive the hands of the watch, since it is necessary to provide in addition the energy to cancel the effect of the elastic latching member.

The invention thus concerns the diminution of the couple necessary to be applied to the date indicator in order to have it make a step.

For instance, British Pat. No. 2 026 213 describes an elastic latching mechanism which is rendered inoperative during the date step in order to reduce the energy necessary during the advance. This mechanism comprises a driving train provided on its periphery with a toothed sector and a transmission train provided with first teeth adapted to mesh with the toothed sector of the driving train and second teeth in mesh with the teeth of the date indicator. A circular cam having a flattened sector is driven onto the axle of the driving train in a manner such that the flattened part is located facing the toothed sector. An elastic latching member formed with two branches is arranged in a manner such that the end of one branch bears on the cam and the end of the other branch comes into contact with the second teeth of the transmission train. The latching member may pivot about a point situated at the junction of the two branches the spread of which is dimensioned in a manner such that they are elastically urged against the cam and the second teeth when the date indicator is not being driven. The elastic support of one of the branches, provided moreover with embossing, assures the desired latching. At the moment that the data indicator makes the step, the flattened portion of the cam is brought into a position facing one branch and annuls the urging force of the other branch on the second teeth. The latching thus being rendered inoperative, the date indicator may be freely displaced. This latching mechanism presents however the difficulty that except for the times when the data is advanced, the cam which is permanently in rotation rubs on one branch, thus producing an undesirable energy loss.

To overcome the above-cited difficulty, the applicant of the present invention has already proposed an arrangement having no elastic latching arrangement such having been described in the Swiss Pat. No. 648 176 corresponding to U.S. Pat. No. 4,478,522 and which is related to mechanisms referred to as Maltese cross mechanisms, which permit driving in discontinuous rotation a driven train from a driving train turning at constant speed. In these mechanisms each actuation phase of the driven train is followed by a blocking phase of said mechanism in which it is unnecessary to employ spring indexing means. In the cited document, the blocking means applied employ a platen borne by the driving member and including a notch in the form of a half moon, said platen cooperating with a plate borne by the driven member and comprising four projecting arms at the extremity of which are fixed studs. This construction, in addition to requiring much space, necessitates special components not usually found in horology and relatively difficult to manufacture.

The purpose of the present invention is to provide an intermittent driving mechanism for a time indicator which avoids the above cited difficulties and which is simple to manufacture while remaining very secure in its operation. This purpose is attained thanks to the means set forth in the claims.

SUMMARY OF THE INVENTION

The invention thus comprises an intermittent driving arrangement for a time indicator in a timepiece including a driving train driven in continuous rotation by the timepiece movement and a transmission assembly driven in discontinuous rotation by said driving train, said assembly driving in turn said indicator, the transmission assembly including first and second coaxial pinions fixed to one another and having the same number of teeth, the diameter of the first pinion being less than the diameter of the second, the driving train including first driving means to set said first pinion into intermittent motion and blocking means to block said second pinion during intervals when said transmission assembly is not driven.

DESCRIPTION OF THE PREFERRED EMBODIMENT

Figure 1:
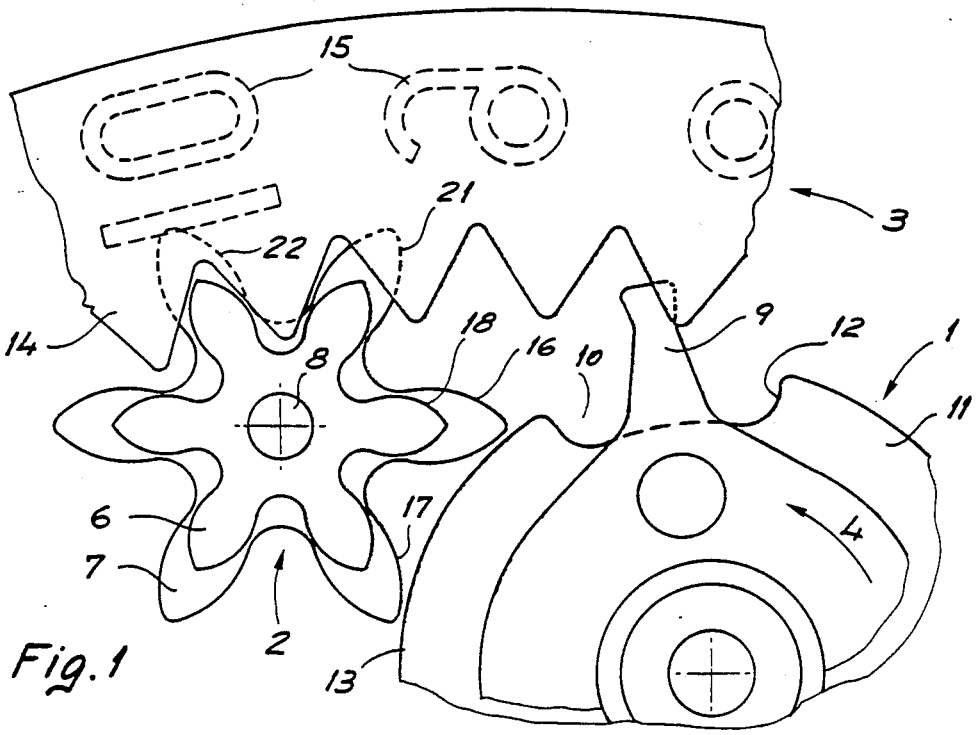
FIGS. 1, 2 and 3 present plan views of the preferred arrangement according to the invention in three different phases of the time indicator, respectively a blocking phase, a first driving phase and a second driving phase.
Figure 2:
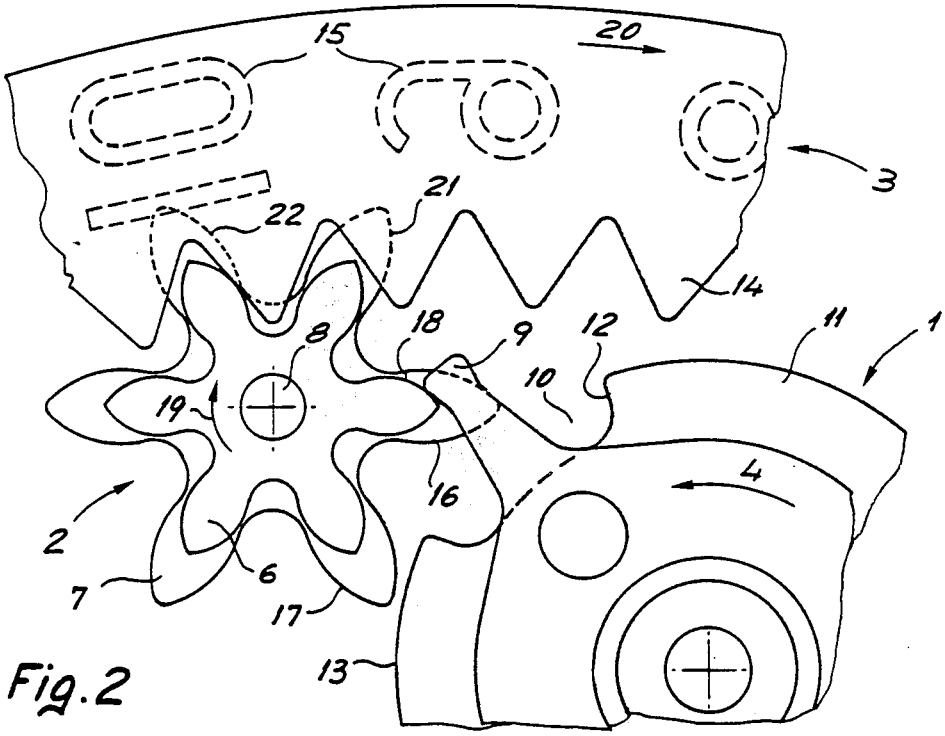
Figure 3:
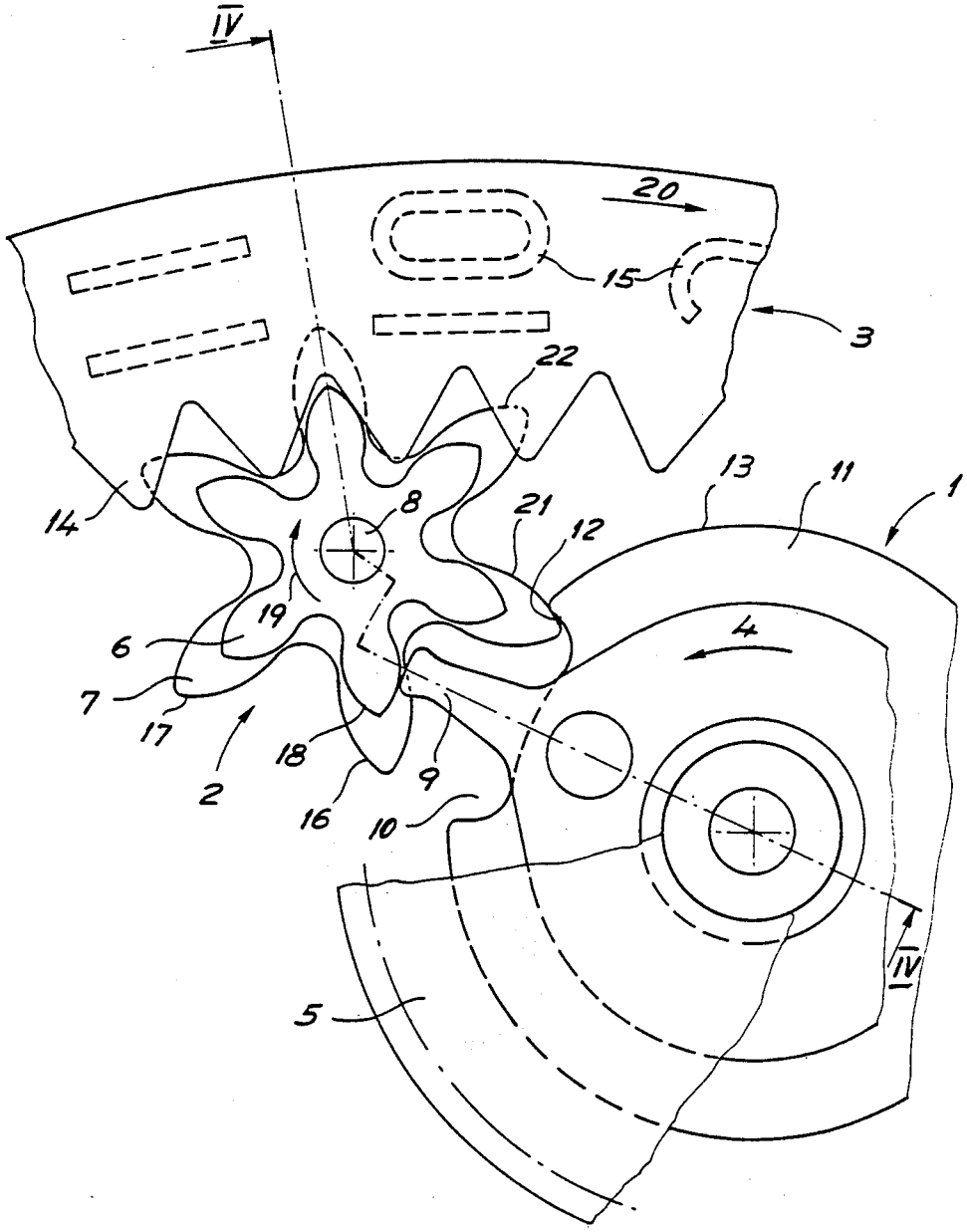

FIGS. 1 to 3 show plan views of the preferred arrangement in accordance with the invention which include essentially a driving train 1, a transmission assembly 2 and a time indicator 3. The driving train 1 is driven in continuous rotation in the sense of the arrow 4 by a wheel 5 shown partially on FIG. 3 only. In the example chosen, the driving train 1 makes one rotation in twenty-four hours, the wheel 5 being continuously in mesh with a counter-wheel itself meshing with the hours wheel (not shown). The transmission assembly 2 includes a first pinion 6 and a second pinion 7 which are fixed to rotate together and coaxial and which have the same number of teeth (six in the construction as shown), the diameter of the first pinion being smaller than the diameter of the second. The transmission assembly 2 is freely rotatable about an axle 8. The driving train 1 includes first and second means for driving intermittently and successively the first pinion 6, then the second pinion 7. It includes furthermore means for blocking the second pinion 7 when it is not being driven. The time indicator 3 is driven by the transmission assembly 2.

In particular, in the preferred arrangement of the invention shown on the drawing, the driving train 1 includes a finger 9 adapted to drive one tooth of the first pinion 6 and a notch 10 cut into the periphery of a plate 11 fixed to the finger and coaxial with the center of rotation thereof. An edge 12 of a notch 10 is adapted to drive a tooth of the second pinion 7. The plate 11 bears a circular flange 13 on which there come to rest two teeth of pinion 7 when the transmission assembly 2 is not being driven, this circular flange comprising the blocking means mentioned hereinabove.

The time indicator 3 as shown here is a date ring provided with internal peripheral teeth including in the chosen construction sixty-two teeth 14. On one of the surfaces of the ring are placed numbers 15 representing the date of the month. As may be seen on FIGS. 1 to 3, the teeth 14 of the ring are in mesh with the teeth of the small pinion 6 included in the transmission assembly 2. It will be understood that the ring could as a variant be driven by the teeth of the large pinion 7.

The preferred arrangement of the drawing shows further that the teeth of the first and second pinions forming the transmission assembly are aligned with one another and that the longitudinal axis of the finger 9 is disposed at the center of the notch 10. In this manner, there is enabled an operation of the arrangement in both senses of rotation and, taking into account the dimensions adopted for the construction as shown, a rotation of 120° of the assembly 2 at each rotation of the driving train 1. It is clear that other arrangements are possible, such as for instance arranging the teeth of the small pinion 6 between the teeth of the large pinion 7. In this case, however, the angle of rotation of the assembly 2 per step would be reduced to 60°.

The operation of the arrangement in accordance with the invention may now be explained in following the different phase shown on FIGS. 1, 2 and 3.

FIG. 1 represents a blocking phase of the transmission assembly 2 and thus of indicator 3. In this position two teeth 16 and 17 of the large pinion 7 rest on the circular flange 13 of the driving train 1. The indicator 3 is maintained in position even should a shock be applied to the timepiece and without recourse to elastic means (jumping acting on the teeth 14 for instance).

The driving train continuing in its course according to the sense of arrow 4, there arrives a moment when the finger 9 comes into mesh with the tooth 18 of the small pinion 6. This is the situation shown on FIG. 2. The transmission assembly then begins to turn in the sense of arrow 19 driving the indicator according to arrow 20. Here we are concerned with the first driving phase of the assembly 2 and which continues as long as the finger remains in contact with the tooth. It will be noted that during this phase, teeth 16 and 21 borne by the large pinion 7 are engaged one after the other in the notch 10 of the driving train.

FIG. 3 shows the beginning of the second driving phase of the transmission assembly 2. At this moment the finger 9 leaves the tooth 18 of the small pinion 6 and the edge 12 oof the notch 10 comes into contact with the tooth 21 of the large pinion 7. Continuing its course according to arrow 4, the driving train further advances the assembly 2 until the ends of teeth 21 and 22 come to rest and are thus blocked on the circular flange 13 to the right of finger 9. At this time the cycle of the passage from one date to the next of the calendar ring has ended and it will be well understood that the first and second pinions have been driven successively, the first 6 by finger 9 and the second 7 by the edge 12 of notch 10. This double action causes the assembly 2 to turn through a substantial angle. The present invention is however not limited to said double action, as will appear further on when FIG. 5 will be discussed.

In the special arrangement which has just been described, the transmission assembly will have turned through 120° during which the driving train will have progressed through about 60°; about 30° by the action of the finger and about 30° by the action of the edge of the notch. During this time the indicator 3 will have progressed through 360/31 degrees.

Figure 4:
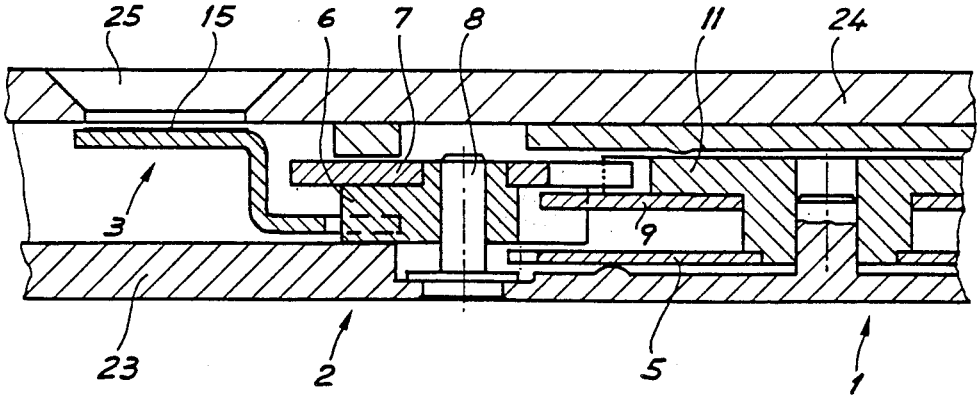
FIG. 4 is a cross-section along line IV—IV of FIG. 3.

FIG. 4 is a cross-section along line IV—IV of FIG. 3. It does not require any particular commentary and simply indicates how the various elements comprising the arrangement of the invention are placed in the sense of the thickness of the timepiece. It will be noted that the mechanism is supported by a base plate 23 on one side of which is a dial 24 pierced with an opening 25 through which will appear the number 15 corresponding to the date. It will be noted that the arrangement extends over three different levels: an upper level on the dial side where the large pinion 7 cooperates with plate 11, an intermediate level where the small pinion 6 cooperates with the finger 9, and a lower level where the same small pinion 6 meshes with the teeth of indicator ring 3.

Date setting of the ring 3 is effected in synchronism with a mechanism (not shown) permitting the correction of the date and acting on the hours hand. Such a mechanism is described for instance in Swiss Pat. No. 526 804 corresponding to U.S. Pat. No. 3,695,035.

Figure 5:
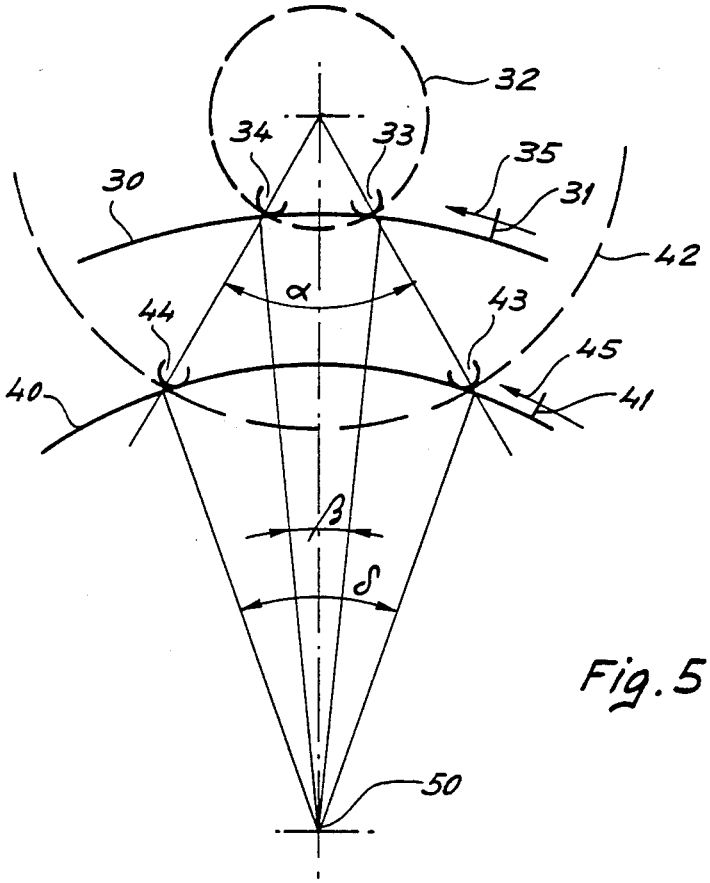
FIG. 5 is a diagram showing schematically the invention according to its widest sense in which diagram may be seen certain advantages brought by said invention.

The diagram of FIG. 5 will enable better understanding of the advantages brought about by the invention and will permit showing it in its widest sense.

There has been drawn a driving train of large diameter schematized by its circular flange 30 and its finger 31. This train pivots at 50 and cooperates with a pinion 32 of small diameter of which two teeth 33 and 34 are shown. The diagram shows that in order to have the pinion 32 advance through a step (angle $\alpha$), it is necessary to cause the finger to turn through an angle $\beta$ relatively small. This construction (pinion 32 of small diameter and wheel 30 of large diameter) thus provides as an advantage a rapid change of date. It exhibits at the same time a serious disadvantage: the risk of butting of the tooth 33 on the circular periphery 30 when this latter turns in the sense of arrow 35 which would have as consequence blocking of the mechanism.

To avoid this difficulty, one is brought to the solution likewise shown on the diagram of FIG. 5 and which consists in employing a driving train of small diameter schematized by its circular flange 40 and its finger 41. This wheel pivots about the same axis 50 and cooperates with a pinion 42 of large diameter on which there have been represented two teeth 43 and 44. In this arrangement, the risk of butting is substantially reduced when the flange turns in the sense of the arrow 45. It is to be noted on the other hand that the time for passing from one date to another is considerably increased since, in order to cause pinion 42 to advance through a step and thus the same angle $\alpha$ as in the case considered in the preceding paragraph, it will be necessary to have the finger turn through a much greater angle δ.

The arrangement according to the invention consists in combining the two solutions shown hereinabove to obtain a time of passage relatively rapid while avoiding the phenomenon of butting. To this effect, on the one hand one has a finger of considerable length act on a pinion of small diameter and on the other hand a pinion of large diameter is used as blocking means for the arrangement by acting on a circular flange of small diameter.

Thus, in the widest sense of the invention and in view of FIG. 5, the driving train pivoting at 50 includes first driving means constituted by a finger 31 and blocking means constituted by the circular flange 40. The finger 31 cooperates with the small diameter pinion 32 and the circular flange 40 cooperates with the large diameter pinion 42. Finger 31 and flange 40 form the driving train; small and large pinions 32 and 42 respectively form the transmission assembly turning intermittently and rapidly.

The preferred form of the invention which has been explained with respect to FIGS. 1 to 4 puts into practice the more general principle illustrated by FIG. 5. In addition to employing the general principle, the preferred form of the invention causes the action of the two driving arrangements to impart to the transmission assembly a greater angular excursion.

What I claim is:

1. Intermittent driving arrangement for a time indicator in a timepiece including a driving train driven in continuous rotation by the timepiece movement and a transmission assembly driven in discontinuous rotation by said driving train, said assembly driving in turn said indicator, the transmission assembly including first and second coaxial pinions fixed to one another and having the same number of teeth, the diameter of the first pinion being less than the diameter of the second, the driving train including first driving means to set said first pinion into intermittent motion and blocking means to block said second pinion during intervals when said transmission assembly is not driven.

2. Intermittent driving arrangement as set forth in claim 1 wherein said driving train further includes second driving means to set said second pinion into intermittent motion, said first and second means being arranged to act one after the other on said transmission assembly.

3. Intermittent driving arrangement as set forth in claim 2 wherein said first and second driving means include respectively a finger adapted to drive a tooth of the first pinion and a notch cut into the periphery of a plate fixed to the finger and coaxial with the center of rotation thereof, an edge of said notch being adapted to drive a tooth of the second pinion, said blocking means being formed by a circular flange of said plate on which rest two teeth of said second pinion when said transmission assembly is not being driven.

4. Intermittent driving arrangement as set forth in claim 3 wherein the teeth of the first and second pinions are aligned with one another, the longitudinal axis of the finger being placed in the center of the notch.

5. Intermittent driving arrangement as set forth in claim 3 wherein the time indicator comprises a ring displaying the date, said ring bearing internal peripheral teeth meshing with the first pinion of the transmission assembly.

* * * * *